United States Patent [19]

Gliha, Jr. et al.

[11] 4,440,463

[45] Apr. 3, 1984

[54] ELECTRICAL CONNECTOR HAVING A METALLIZED PLASTIC GROUNDING INSERT

[75] Inventors: Edward R. Gliha, Jr., Bainbridge; Christopher Marks, Guilford, both of N.Y.

[73] Assignee: The Bendix Corporation, Southfield, Mich.

[21] Appl. No.: 314,901

[22] Filed: Oct. 26, 1981

[51] Int. Cl.[3] ..... H01R 4/66

[52] U.S. Cl. ..... 339/14 R; 339/147 P

[58] Field of Search ..... 339/14 R, 143 R, 147 R, 339/147 P, 147 C, 275 C, 275 R; 333/182, 183

[56] References Cited

U.S. PATENT DOCUMENTS

| | | | |
|---|---|---|---|
| 3,569,915 | 3/1971 | Sorenson et al. | 339/143 R |
| 3,670,292 | 6/1972 | Tracy | 339/143 R |
| 3,743,979 | 7/1973 | Schor | 339/79 |
| 4,029,386 | 6/1977 | Krantz, Jr. et al. | 339/143 R |

*Primary Examiner*—John McQuade

*Assistant Examiner*—David L. Pirlot

*Attorney, Agent, or Firm*—John R. Benefiel; Raymond J. Eifler

[57] ABSTRACT

An electrical connector having a plated plastic grounding insert (12) providing an electrical connection from a grounding electrode (18) to the connector shell (14) the ground insert (12) including integral spring fins (22) extending diposed about the periphery of the insert and extending from a rear face thereof compressibly received within a bore (26) in the connector shell (14). Grounding towers (30) are also formed integrally with the grounding insert (12), including a generally conical proturbance (30) extending from the front face of the insert with slots (32) providing resiliency for friction engagement of the grounding electrode (18). The grounding insert (12) and contacts (16) are supported by encapsulating material (36, 38) disposed on either side of the insert (12). The insert (12) is coated with a cnductive layer such as metallic silver to enable establishment of the electrical connections.

10 Claims, 7 Drawing Figures

ELECTRICAL CONNECTOR HAVING A METALLIZED PLASTIC GROUNDING INSERT

This invention relates to electrical connectors and more particularly to electrical connectors of the type including means for electrically grounding electrode portions of at least some of the connector contacts to the outer connector shell.

In certain electrical connectors there is provided means for preventing the transmission of high frequency transient voltages, which comprises a filter which includes electrode portions carried by the connector contacts and grounded to the connector shell.

In a prior arrangement shown in U.S. Pat. No. 4,029,386, issued June 14, 1977 for a "Connector Having a Plated Plastic Ground For Filter Contacts" cylindrical electrodes are included in which the filter portion of the contacts are received, the electrodes in turn received into a grounding insert.

The grounding insert includes a grounding disc or wafer being formed with through openings to receive the grounding electrodes and with a series of grounding towers electrically connecting each of the electrodes to the insert.

In order to provide a mechanical-electrical connection to the interior of the connector shell, a separate grounding ring is provided which frictionally engages the exterior of the grounding insert as well as the interior of the connector shell. The grounding wafer or disc must be securely grounded to the shell bore interior in order to provide reliable ground junctions such as to insure that filter performance is maintained even for very high frequency voltages beyond 100 MHz.

Alternatively, soldered connections have been employed to provide a secure and stable connection from the grounding plate of wafer to the connector shell.

The need for a separate ground ring increases the complexity and cost of the connector while soldering or other joining methods increase the manufacturing costs of and reduce the reliability of performance, if proper soldered joints are not achieved during manufacturing.

U.S. Pat. No. 3,569,915 issued on Mar. 9, 1971 entitled "Grounding Foil" describes a one piece grounding tail for mounting the filters. This design however required a delicate forming process to be carried out on very thin sheet metal.

DISCLOSURE OF THE INVENTION

The present invention is an electrical connector having a grounding insert consisting of a molded plastic disc which is metallized by a surface treatment so as to render its entire surface conductive. The disc is formed with trailing spring fins extending to the rear of the disc and inclined slightly outwardly such as to be compressibly received within a bore formed in the connector shell. The trailing configuration of the fins enables the disc portion to be of minimum diameter and compatible with existing connector componentry while providing a reliable electrical connection between the disc and the connector shell. The grounding insert is also formed with integral grounding towers consisting of conically shaped protrubances concentric to through openings formed therein and slotted about their periphery such as to directly grip the grounding electrode portion of the filter contacts. The grounding insert is located against a shoulder formed adjacent the connector shell bore receiving the grounding insert with encapsulating material being added on either side to locate and seal the componentry within the connector shell.

The major advantage of this arrangement is the simplification of the grounding insert and its manufacture and of the connector itself while maintaining a high degree of reliability of the electrical connections provided by the insert to the connector shell, resulting in lower manufacturing costs and higher reliablity of the completed connector.

DETAILED DESCRIPTION OF THE INVENTION

Figure 1:
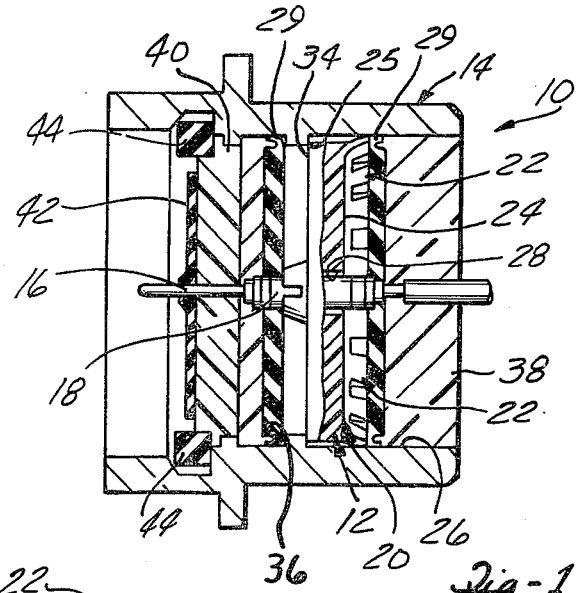
FIG. 1 is a view in partial longitudinal section of an electrical connector incorporating a grounding insert according to the present invention.

Referring to FIG. 1, an electrical receptable connector 10 is shown incorporating a grounding insert 12 according to the present invention. The receptacle connector 10 includes a generally cylindrical connector shell 14 adapted to house and mount various typical connector components. These components include at least one EMI filtered pin contact 16 mounted together to the shell 14, the EMI filtered pin contact 16 including a grounding electrode 18 disposed thereover and forming a part of a filter of the type well known in the art.

Each of the pin contacts 16 and filter grounding electrodes 18 are supported on a disc portion 20 of the grounding insert 12, the disc portion 20 being formed with a series of spring fins 22 and with a plurality of through openings 28 adapted to receive the pin contact 16 and filter grounding electrodes 18. The grounding insert 12 is compressibly received within a bore 26 formed in the connector shell 14 and abutted against a shoulder 25. Encapsulating material such as epoxy is disposed in regions 36 and 38 on either side of the grounding insert 12 so as to secure the same as well as the other components within the connector shell 14.

Seals 29 are also included at the front and rear of the connector respectively to seal off the insert 12 and prevent epoxy from reaching the spring fins 22.

The receptable connector 10 may also receive an insert 40 at the forward end of the connector and over each of the pin contacts 16 and an interfacial (moisture) seal 42, the seal being bonded to a forward face of the insert 40. A suitable gasket 44 may also be provided for sealing a mating plug connector (not shown) connected thereto.

Figure 2:
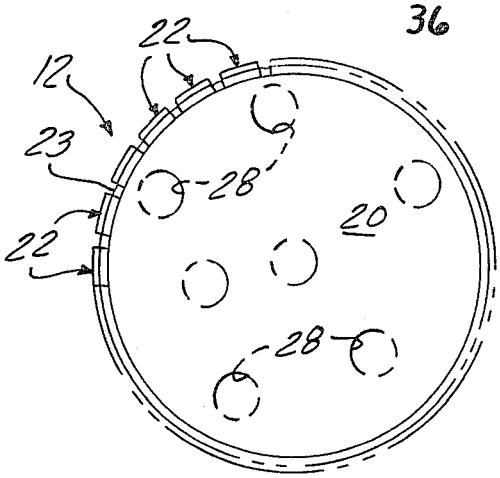
FIG. 2 is an end wise view of the grounding insert incorporated in the electrical connector shown in FIG. 1.

FIG. 2 illustrates the grounding insert 12 having the previously described through openings 28 formed through the center of disc portion 20. Integral with disc portion 20 are the series of spring fins 22, each of the fins being disposed about the periphery of the disc portion and extending in a trailing fashion from a rear face 24 of the disc portion 20.

Figure 3:
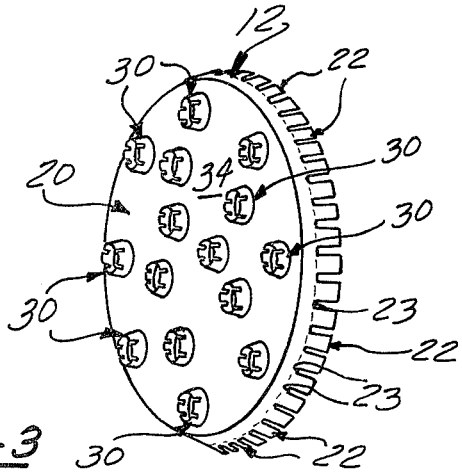
FIG. 3 is a perspective view of the grounding insert shown in FIG. 2.

FIG. 3 illustrates how the slight outward inclination of the spring fins 22 produces a flared skirt which is adapted to be compressed on being disposed within the bore 26 of the connector shell 14 which is to be placed in firm and secure contact.

Figure 4:
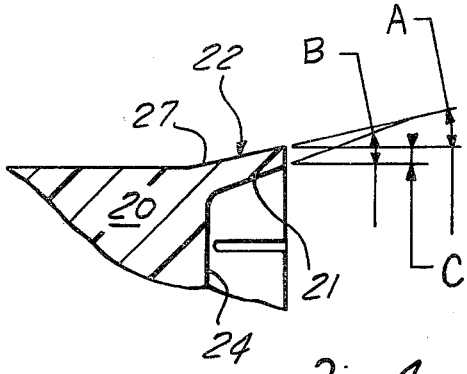
FIG. 4 is an enlarged fragmentary view of a spring fin portion of the grounding insert shown in FIGS. 2 and 3.

FIG. 4 shows the details of each of the spring fins 22 which is formed by interposed slots 23 extending between each of the spring fins 22. Each spring fin 22 is of a tapered construction formed by a slightly inclined outside surface 27 extending at the angle A which, in a preferred embodiment comprises an angle on the order of 5°, and a more steeply inclined inside surface 21 inclined at the Angle B which in the preferred embodiment is 15° to produce a convergency between the surfaces 21 and 27 to provide proper resiliency.

The radial thickness (at the distal end) of each fin is on the order of the Dimension C which, in the preferred embodiment, is approximately equal to 0.046 cm (i.e. 0.018 inches).

It can be seen that by this construction, in which the spring fins 22 project rearwardly with a slight inclination outwardly to form the skirt shape shown, enables the center of disc portion 20 to be configured of minimum diameter.

This feature is significant in the context of redesigning existing connectors to employ the grounding insert according to the present invention in that the existing shell and contact pin patterns may be preserved with the minimal portion of the diameter of the insert being occupied by the spring fin portions. At the same time very adequate resiliency of the spring fins 22 is provided to insure a firm and stable grounding junction between the grounding insert and the interior bore 26 of the connector shell 14. The grounding insert 12 is contemplated as being constructed of a molded plastic which may be coated, as by vapor deposition, sputtering etc., with a layer of a conductive substance to enable the electrical connection being made from the grounding electrode 18 to the connector shell 14. High temperature thermo plastics such as "Mendel" plastic have been found to have suitable metallizable characteristics and provide the necessary spring force. Silver metal coating has been successfully employed.

Grounding insert 12 also includes at least one grounding tower corresponding to each contact 16 and grounding electrode 18. The grounding tower construction may be of the design described in the aforementioned U.S. Pat. No. 4,029,386.

Figure 5:
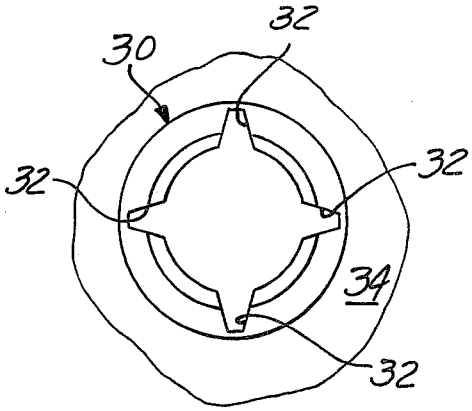
FIG. 5 is a fragmentary view of the front portion of the grounding insert shown in FIGS. 2 through 4 showing the details of grounding tower portions thereof.
Figure 6:
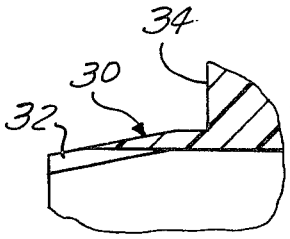
FIG. 6 is an enlarged sectional view through one of the grounding towers showing a typical configuration thereof.

FIGS. 5 and 6 illustrate a grounding tower construction of integral construction with the grounding insert 12 and includes a generally conical protrubance 30 projecting from the face 34 of the disc portion 20 of the grounding insert 12 and is provided with a series of slots 32 extending partially through to the conical protrubance 30 to provide a secure gripping of the exterior of the electrode portion 18.

The desired electrical connection is thus directly from the grounding electrode 18 to the connector shell 14 via the grounding insert 12.

Figure 7:
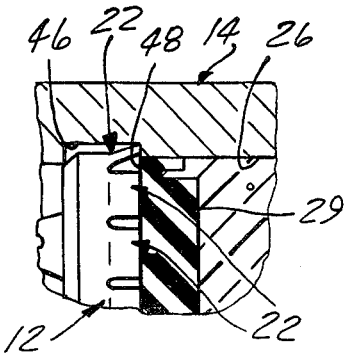
FIG. 7 is a fragmentary view of an alternative connector construction according to the present invention.

FIG. 7 illustrates a retention feature including an undercut 46 forming a shoulder 48 behind which the spring fins 22 snap, to positively retain the grounding insert 12.

Accordingly it can be seen that the construction of the electrical connector 10 employing the grounding insert 12 according to the present invention is simplified. At the same time a highly reliable and stable electrical connection is made by virtue of the one piece integral construction over the prior art constructions.

Many variations of the invention are of course possible such as the use of angles, other plating materials and/or plastics having suitable characteristics.

Having described the invention what is claimed is:

1. In combination with an electrical connector of the type having a plated plastic grounding insert, said connector including a generally cylindrical connector shell, having a bore formed therein at least one contact mounted in said shell having a grounding electrode to be grounded to said shell and a grounding insert electrically connecting said electrode of said at least one contact to said connector shell said grounding insert consisting of a disc portion, and a series of integral spring fins disposed about the periphery of said disc portion, trailing from the rear face thereof and inclined radially outwardly, said spring fins being compressibly received in said bore formed in said shell; said insert further being formed with at least one opening extending through said disc portion corresponding to each of said at least one contact and each located to receive said contact with said grounding electrode and each having an integral generally conical grounding tower surrounding each of said at least one opening and adapted to grip said electrode of said at least one contact passing therethrough, the improvement wherein said grounding insert is comprised of a molded plastic member having a conductive surface layer integrally applied thereto to completely cover the member.

2. The connector according to claim 1 wherein said spring fins extend at a shallow angle on the order of 15° from the axis of said disc portion.

3. The connector according to claim 2 wherein said spring fin thickness is on the order of 0.018 inches.

4. The connector according to claim 3 wherein said grounding insert is molded from metallizable plastic.

5. The connector according to claim 4 wherein said grounding insert is coated with silver metal.

6. The connector according to claim 1 wherein each of said grounding towers is formed with longitudinal slots located about the periphery thereof.

7. The connector according to claim 6 wherein each of said at least one grounding towers project from the forward face of said disc portion.

8. The connector according to claim 1 wherein said grounding insert is abutted against a shoulder formed in said connector shell, and encapsulated by encapsulating material disposed on either side thereof within said shell.

9. The connector according to claim 1 wherein each of said spring fins is of tapered construction having a slightly converging inside surface and outside surface.

10. The connector according to claim 1 wherein said bore found in said shell is founded with a retention undercut creating a shoulder behind which said spring fins are positioned.

* * * * *